US011737517B2

(12) United States Patent
Alviani

(10) Patent No.: US 11,737,517 B2
(45) Date of Patent: Aug. 29, 2023

(54) SHOE HAVING AN INTERCHANGEABLE HEEL

(71) Applicant: Alice G. Alviani, Waukegan, IL (US)

(72) Inventor: Alice G. Alviani, Waukegan, IL (US)

( * ) Notice: Subject to any disclaimer, the term of this patent is extended or adjusted under 35 U.S.C. 154(b) by 0 days.

(21) Appl. No.: 16/864,880

(22) Filed: May 1, 2020

(65) Prior Publication Data

US 2020/0375313 A1 Dec. 3, 2020

Related U.S. Application Data

(60) Provisional application No. 62/920,981, filed on May 28, 2019.

(51) Int. Cl.

| | |
|---|---|
| ***A43B 21/52*** | (2006.01) |
| ***A43B 21/40*** | (2006.01) |
| ***A43B 21/51*** | (2006.01) |
| *A43B 21/48* | (2006.01) |

(52) U.S. Cl.

CPC ..... *A43B 21/52* (2013.01); *A43B 21/40* (2013.01); *A43B 21/51* (2013.01); *A43B 21/48* (2013.01)

(58) Field of Classification Search

CPC ..... A43B 21/40; A43B 21/36; A43B 21/51; A43B 21/52; A43B 21/48; A43B 3/246

See application file for complete search history.

(56) References Cited

U.S. PATENT DOCUMENTS

| | | | | |
|---|---|---|---|---|
| 1,343,353 A | | 6/1920 | Des Moineaux | |
| 1,479,421 A | | 10/1920 | Powell | |
| 1,439,600 A | * | 12/1922 | Bonawitz | A43B 21/40 D2/968 |
| 1,575,664 A | | 8/1924 | Van Roy | |
| 1,542,174 A | | 6/1925 | Robidoux | |
| 1,557,564 A | | 10/1925 | Daquino | |

(Continued)

FOREIGN PATENT DOCUMENTS

| | | |
|---|---|---|
| FR | 823964 | 1/1938 |
| KR | 10-2017-0046935 | 5/2017 |
| WO | 2016179675 | 11/2016 |

OTHER PUBLICATIONS

Exhibit A: Three photos of prior art grand piano leg plates for fastening grand piano legs to a grand piano. as filed on Mar. 21, 2023.

(Continued)

*Primary Examiner* — Ted Kavanaugh

(74) *Attorney, Agent, or Firm* — Erickson Law Group, PC

(57) ABSTRACT

A shoe having an interchangeable heel is disclosed. The shoe has a sole, a receiving recess, and a heel. The receiving recess is in a heel area of the shoe below an insole of the sole. The heel has a key on a top side of the heel configured to engage the receiving recess. The key is movable within the receiving recess between a released position and an engaged position. In the engaged position each key first engagement portion is engaged with one of the receiving first engagement portions and each key second engagement portion is engaged with one of the receiving second engagement portions to join the key to the perimeter and the heel to the sole. In the released position each key first engagement portion is aligned with one of the receiving non-engagement recesses and the key is removable from the receiving recess.

13 Claims, 12 Drawing Sheets

(56) References Cited

U.S. PATENT DOCUMENTS

| | | | | | |
|---|---|---|---|---|---|
| 1,611,024 | A | | 12/1926 | Grimaldi | |
| 1,631,710 | A | | 6/1927 | Tranides | |
| 1,709,332 | A | | 5/1928 | Tager | |
| 1,685,871 | A | | 10/1928 | Asher | |
| 1,709,749 | A | | 4/1929 | Hahbender | |
| 1,966,293 | A | | 7/1934 | Gillis | |
| 1,994,014 | A | | 3/1935 | Christensen | |
| 2,195,128 | A | | 3/1940 | Gillis | |
| 2,320,584 | A | | 6/1943 | Giesser | |
| 2,435,723 | A | * | 2/1948 | Elliot | A43B 21/37 36/36 R |
| 2,439,310 | A | * | 4/1948 | Mancuso | A43B 21/40 36/42 |
| 2,795,867 | A | | 6/1957 | Zuckerman et al. | |
| 2,806,302 | A | | 9/1957 | Sharpe | |
| 2,837,841 | A | | 6/1958 | Twedt | |
| 2,943,404 | A | | 7/1960 | Sultan | |
| 3,064,367 | A | | 11/1962 | Henatsch | |
| 3,077,680 | A | * | 2/1963 | Moustakidis | A43B 21/40 D2/968 |
| 3,176,417 | A | | 4/1965 | Kapps | |
| 3,188,755 | A | | 6/1965 | Cortina | |
| 3,646,497 | A | | 2/1972 | Gillikin | |
| 4,014,115 | A | | 3/1977 | Reichert | |
| 4,610,100 | A | * | 9/1986 | Rhodes | A43B 21/39 36/36 A |
| 4,805,320 | A | | 2/1989 | Goldenberg et al. | |
| 5,025,574 | A | | 6/1991 | Lasher, III | |
| 5,058,290 | A | | 10/1991 | Koehl et al. | |
| 5,343,649 | A | | 9/1994 | Petrovich | |
| 5,456,026 | A | | 10/1995 | Lewis | |
| 5,519,950 | A | | 5/1996 | Wang | |
| 5,953,836 | A | | 9/1999 | Watt et al. | |
| 6,711,835 | B1 | | 3/2004 | Militello | |
| 7,185,448 | B2 | | 3/2007 | Schupbach | |
| 7,578,075 | B1 | | 8/2009 | Kemp | |
| 7,954,256 | B2 | | 6/2011 | Colella | |
| 9,486,032 | B2 | | 11/2016 | Morris thill | |
| 10,201,209 | B2 | * | 2/2019 | Obie | A43B 3/246 |
| 2001/0052195 | A1 | | 12/2001 | Blakey | |
| 2003/0163934 | A1 | | 9/2003 | Wallin et al. | |
| 2006/0075662 | A1 | | 4/2006 | Schupbach | |
| 2011/0179670 | A1 | | 7/2011 | Lepour | |
| 2013/0067770 | A1 | * | 3/2013 | Sherwood | A43B 21/39 36/100 |
| 2014/0259777 | A1 | | 9/2014 | Morris Thill | |
| 2014/0298685 | A1 | | 10/2014 | Alan et al. | |
| 2015/0201704 | A1 | | 7/2015 | Huber | |

OTHER PUBLICATIONS

Exhibit B: A photo of a prior art grand piano leg plate fixed to a grand piano leg. as filed on Mar. 21, 2023.

* cited by examiner

SHOE HAVING AN INTERCHANGEABLE HEEL

This application claims the benefit of U.S. Patent Application No. 62/920,981, filed May 28, 2019.

FIELD OF THE INVENTION

This invention relates in general to interchangeable heel devices for shoes.

BACKGROUND OF THE INVENTION

Until now, all interchangeable heels have been complex and expensive to produce. Currently available interchangeable heels have bulky and complex mechanisms that may interfere with good shoe design and structure or invite malfunction over time.

The present inventor recognized that it would be desirable to allow the heels of shoes to be easily changed for other shoe heels onto the same shoe body, for any of several reasons, including but not limited to fashion, comfort, health and thriftiness. The present inventor recognized the need for an interchangeable heel device that is simpler, more secure, and less costly to manufacture. The present inventor recognized the need for an interchangeable heel device that could be mass-produced economically and would not necessarily be limited to hand-made boutique women's shoes.

The present inventor recognized that providing an interchangeable heel is important because many women have multiple activities during a single day, where it is impracticable to carry the variety of shoes socially required/desired. Many women cannot tolerate fashionable high heels for long periods of time, especially as they grow older. Further, it is common for a woman's feet to have been severely damaged from wearing traditional heeled shoes, limiting her activities, which may lead to obesity and other health issues, in addition to orthopedic issues.

The present inventor recognized the need for a device that enabled a user to carry optional or changeable heels on the user's person that could fit into nearly any pocket or handbag, to change out in seconds, making practicable fashion, comfort or better health as needed.

The present inventor recognized that an interchangeable heel is a desirable option for men's shoes because some men also have fashion or health requirements or desires similar to women as described above. Men also may want a more fashionable look for certain non-business activities.

The present inventor recognized the need for a device that could also be helpfully incorporated into dressy shoes for older children, especially girls, whose sensible parents don't want their fragile, developing feet in high heels all day when participating in, say, a family wedding.

It is common for the heel to be the first part of a shoe to wear unevenly, causing the user orthopedic issues or other joint pain, as well as possible tripping hazards. The present inventor recognized that shoes with a detachable heel could be sold with at least two pairs of heels. Further, the present inventor recognized the detachable heels would allow spare or extra heels to be readily available and sold separately at a later date. The present inventor recognized that a shoe with detachable heals enables a consumer to purchase identical heels (for a second "lease on life" for favorite shoes by new heels) or different height heels ("flats" and "high heels" for example) or different colors or styles for the same shoe. This would allow more fashion choices from the same high-quality shoe body, by offering an assortment of less-expensive heels. The present inventor recognized that a detachable or interchangeable heel shoe could allow users to make their own unique heel design on a 3-D printer.

The present inventor recognized that an interchangeable heel device could easily accommodate individuals with certain orthopedic issues, such as different length legs, by use of a shim or wedge between the body of the shoe and the heel, available either from a manufacturer or produced from a 3-D printer. The present inventor recognized the need for an interchangeable heel device to allow self-treatment of certain conditions without the need to use shoe insert on the insole which might compromise the shoe's fit and/or support. Such an interchangeable heel device could enable patients to access a wider variety of non-prescription shoe styles.

The present inventor recognized the need for an interchangeable heel device that is durable, simple to clean if ever required, compact and low-profile to simplify shoe design. The present inventor further recognized the need for a design that is discrete and out-of-sight when worn. The present inventor recognized the need for an interchangeable heel device that accommodates or comprises shims or wedges that could be helpful to alleviate orthopedic issues without compromising shoe fit or support, such as might be encountered when using inserts for use on top of the insole. The present inventor recognized the need of for an interchangeable heel device that can accommodate fashion options such as heels containing colored liquids, sparkles, LED lights, or other designs, if desired.

SUMMARY OF THE INVENTION

An interchangeable heel device for a shoe is disclosed. A shoe having an interchangeable heel is disclosed. The shoe has a sole, a receiving recess, and a heel. The receiving recess is in a heel area of the shoe below an insole of the sole. The heel has a key on a top side of the heel configured to engage the receiving recess.

The key has a first key side opposite a second key side. The first and second key sides each have a key first engagement portion and a key second engagement portion and a key recessed region between the key first engagement portion and the key second engagement portion.

The receiving recess has a perimeter. The perimeter has a first receiving side opposite a second receiving side. The first and second receiving sides each have a receiving first engagement portion and a receiving second engagement portion and a receiving non-engagement recess between the receiving first engagement portion and the receiving second engagement portion.

The key is movable within the receiving recess between a released position and an engaged position. In the engaged position each key first engagement portion is engaged with one of the receiving first engagement portions and each key second engagement portion is engaged with one of the receiving second engagement portions to join the key to the perimeter and the heel to the sole. In the released position each key first engagement portion is aligned with one of the receiving non-engagement recesses and the key is removable from the receiving recess.

Numerous other advantages and features of the present invention will become readily apparent from the following detailed description of the invention and the embodiments thereof, from the claims, and from the accompanying drawings.

DETAILED DESCRIPTION

The following description is presented to enable any person skilled in the art to make and use the invention. For the purposes of explanation, specific nomenclature is set forth to provide a plural understanding of the present invention. While this invention is susceptible of embodiment in many different forms, this description describes and the drawings show specific embodiments of the invention with the understanding that the present disclosure is to be considered as an exemplification of the principles of the invention and is not intended to limit the invention to the specific embodiments illustrated.

Figure 1:
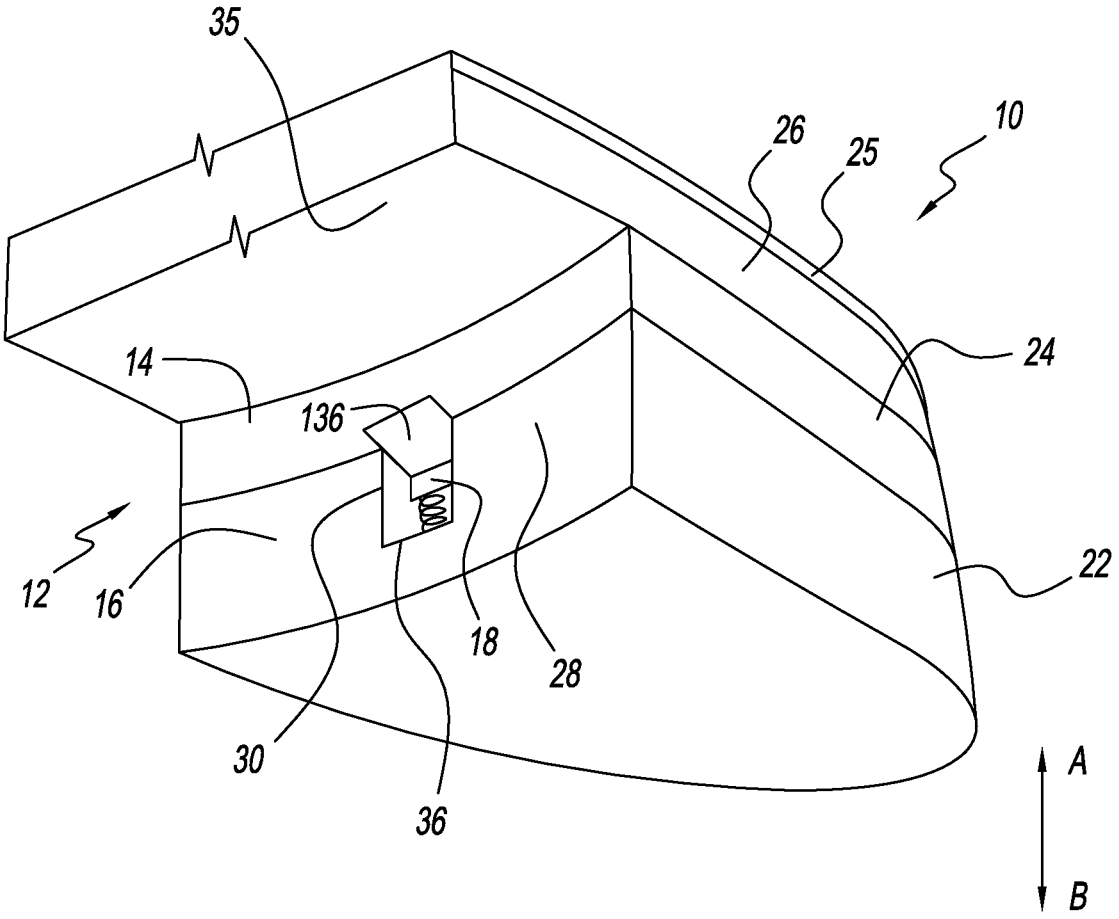
FIG. 1 is a bottom perspective view of a portion of a shoe having an interchangeable heel device of the invention.
Figure 2:
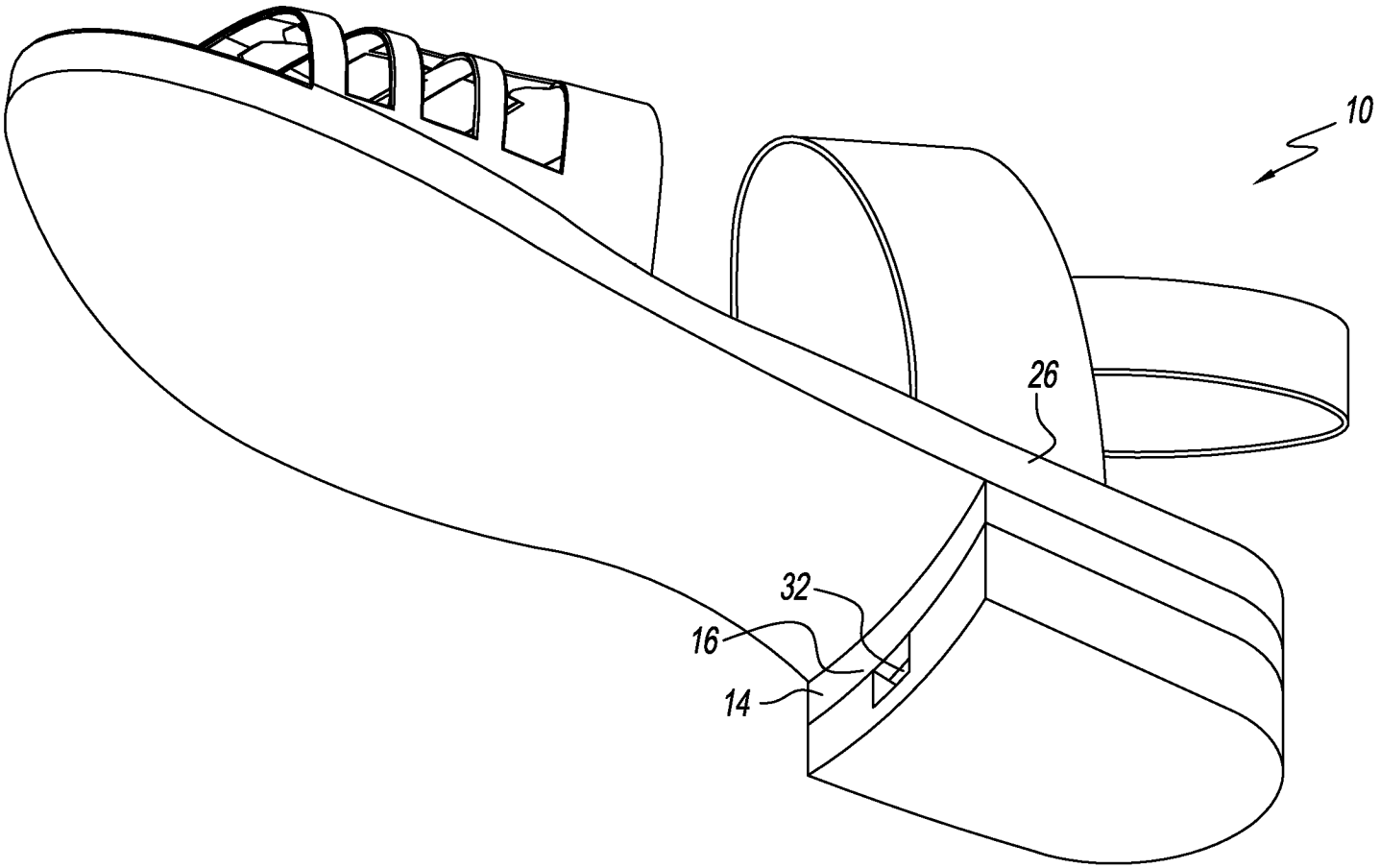
FIG. 2 is a bottom perspective view of the shoe and interchangeable heel device of FIG. 1.

FIG. 1 shows a portion of a shoe 10 comprising a interchangeable heel device 12. The device 12 comprises an upper heel block 14, a lower heel block 16, and a stop 18. The device 12 removably attaches a heel 22 to a sole 26 or upper heel portion 24 of the shoe 10. The sole 26 may comprise an insole 25, which may be for contact with a user's foot.

In some embodiments, the stop 18 is exterior of a front 28 of the heel 22 under the mid-sole 35 of the sole 26. In some embodiments, the stop 18 is integrated within a recess 30 of the heel at the front 28. The recess is large enough to allow verticle movement of the stop 18 in and out of the stop home opening 32 of the upper heel block 14.

Figure 3:
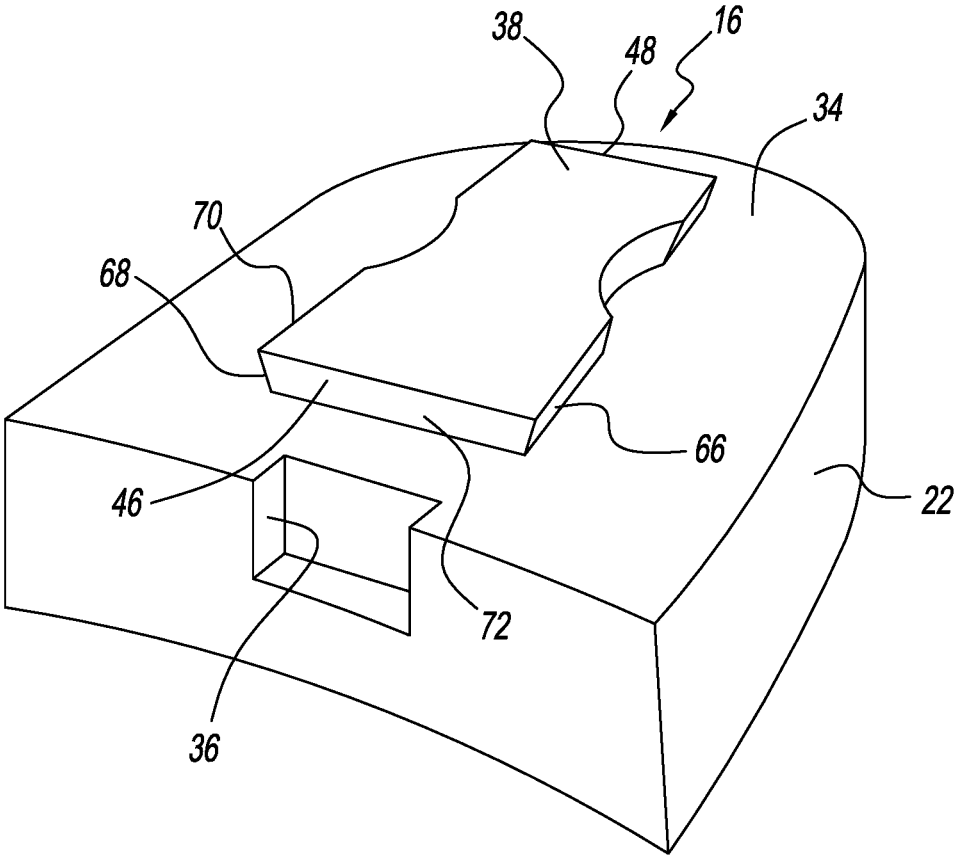
FIG. 3 is a front perspective view of a lower heel block, and key of the interchangeable heel device of FIG. 1.
Figure 4:
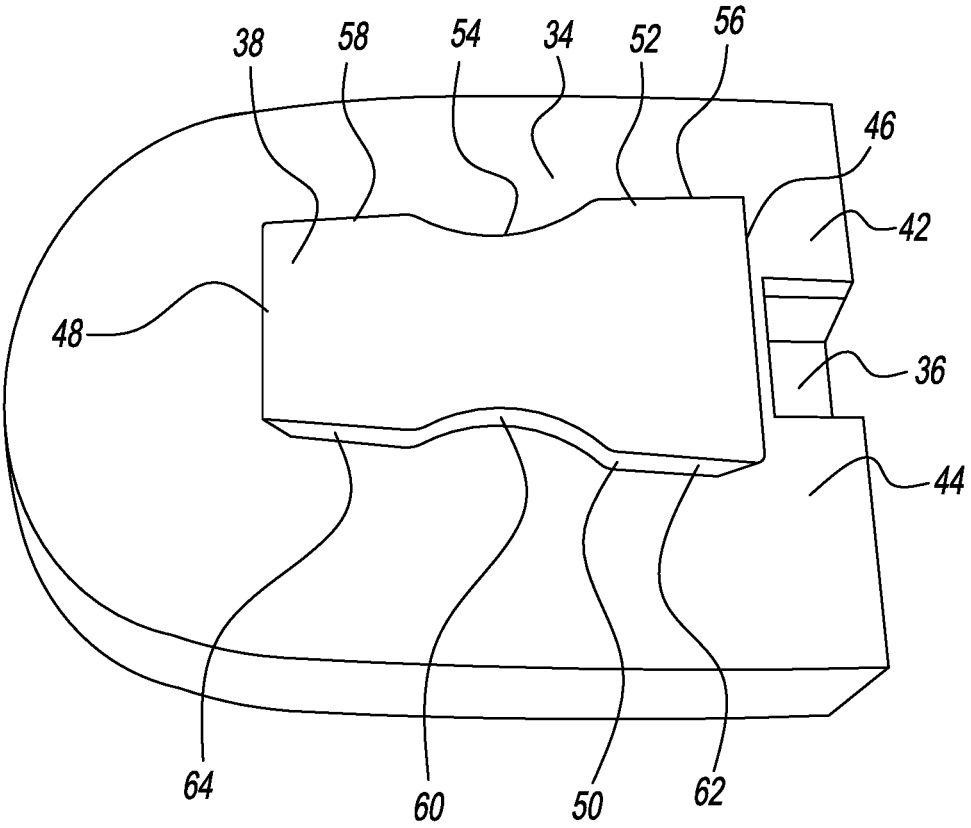
FIG. 4 is a top perspective view of the lower heel block and key of FIG. 3.
Figure 5:
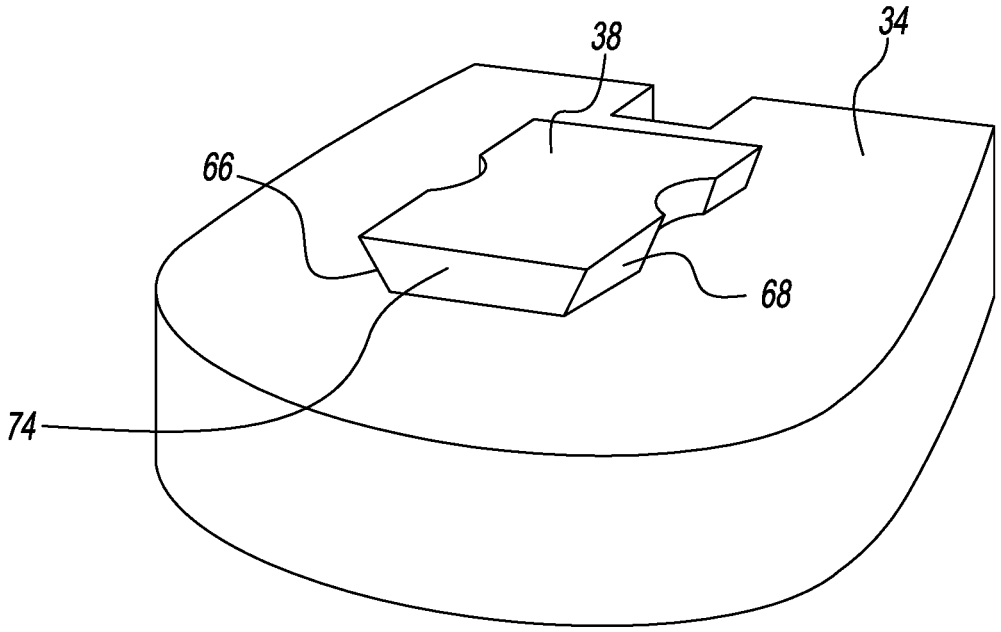
FIG. 5 is a rear perspective view of the lower heel block and key of FIG. 3.

FIG. 3 shows the lower heel block 16. The lower heel block comprises a base 34. In some embodiments the base 34 is flat. In some embodiments the base 34 comprises a slight curve or is otherwise not flat. The base 34 comprises a front notch 36 for the stop 18 to pass through. Projections 42, 44 are provided on opposite sides of the notch 36. Extending from the base is a key 38.

The key 38 comprises a front end 46, and back end 48, a first side 50, and a second side 52. The front end 42 is narrower than the back 48 end. The first and second sides converge toward each other from the backend to the front end. This provide the key with a wedge-shape having a truncated back end 48.

The first side comprises a first indent 54 between a forward portion 56 and a rearward portion 58. The second side comprises a second indent 60 between a forward portion 62 and a rearward portion 64. The first and second indents can be curved, semi-circular, quadrilateral, or other shape.

The first side 50 comprises a first sidewall 66 and the second side 52 comprises a second sidewall 68. The sidewalls 66, 68 converge as they extend from a top 70 of the key to the base 34. In some embodiments, each sidewall 66, 68 is angled to provide an angle 61 (FIG. 12) between 80 degrees and 45 degrees, inclusive, from the adjacent floor of the base 34, but other angles can be used. In some embodiments, the sidewalls at the indents 54, 60 are converging. In some embodiments, the sidewalls at the indents 54, 60 are not converging while the adjacent forward and rearward portions 52, 58, 62, 64 of the sidewalls are converging.

The front end 46 comprises a front wall 72 and the back end 48 comprises a back wall 74. In some embodiments, the front wall and back wall converge as they extend from the top 70 of the key to the base 34. In some embodiments, the front wall and the back wall are angled to provide an angle between 80 degrees and 45 degrees, inclusive, between the respective front wall or back wall and the adjacent surface of the base 34, but other angles can be used.

Figure 6:
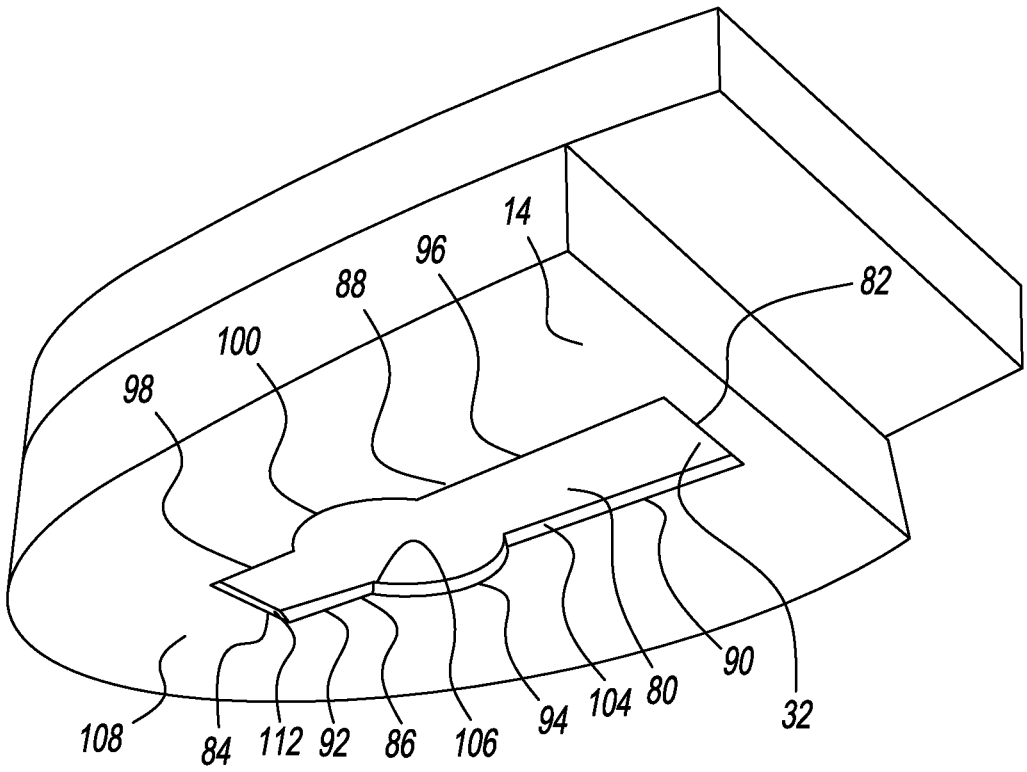
FIG. 6 is a bottom side perspective view of an upper heel block and key opening of the interchangeable heel device of FIG. 1.
Figure 7:
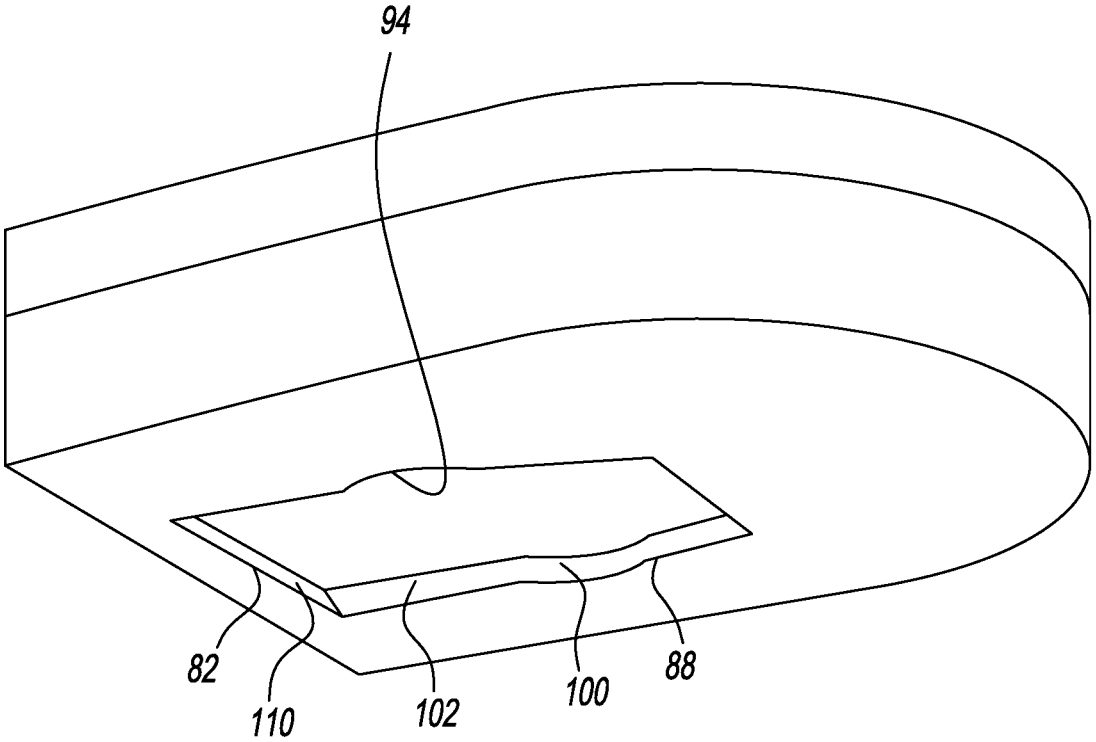
FIG. 7 is a bottom side perspective view of an upper heel block and key opening of FIG. 6.
Figure 8:
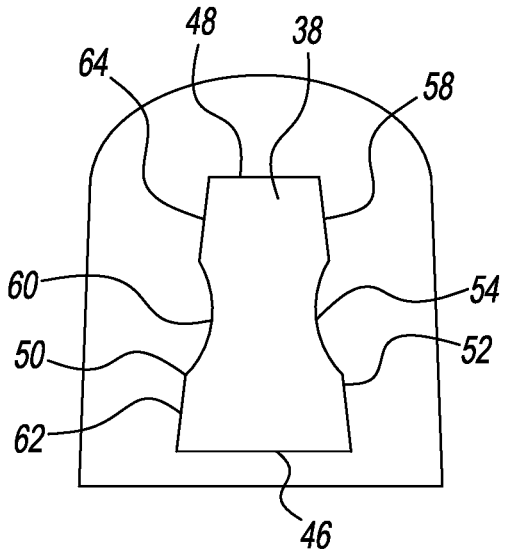
FIG. 8 is a top view of the key of FIG. 4.

FIGS. 6 and 7 shows the upper heel block 14. The heel block 14 comprises a receiving recess or key opening 80. The opening 80 comprises a perimeter comprising a front end 82, a rear end 84, a first side 88, and a second side 86. In some embodiments, the recess 80 has a wedge-shape from a front end 82 with a truncated rear end 84. The receiving recess 80 comprises the stop home opening 32 as shown in FIG. 6 at the front end 82.

In some embodiments, the device 12 comprises the receiving recess or key opening 80 in the sole 26, rather then in an upper heel block.

The first side 88 comprises a first indent 100. The first indent 100 is between a forward portion 96 and a rearward portion 98. The second side 86 comprises a second indent 94. The second indent 94 is between a forward portion 90 and a rearward portion 92.

Figure 12:
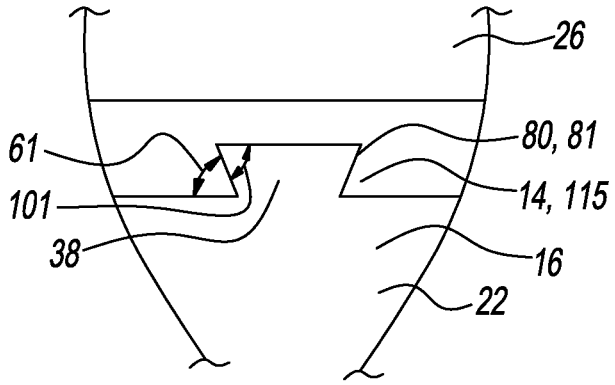
FIG. 12 is a rear section view of the key and key opening taken along 12-12 of FIG. 11.

The first side 88 comprises a first sidewall 102 and the second side 86 comprises a second sidewall 104. The sidewalls 102, 104 converge as they extend from a top 106 of the opening 80 to a bottom 108 of the heel block 14. In some embodiments, each sidewall 102, 104 has an angle 101 (FIG. 12) that is complementary and configured to mate with the angle of the side wall 66, 68 of the key 38, as shown in FIG. 12 in a dovetail engagement. In some embodiments, each sidewall 102, 104, is angled to provide an angle of between 80 degrees and 45 degrees, inclusive, between the respective sidewall and the adjacent surface of the bottom 108, but other angles can be used. In some embodiments, the sidewalls at the indents 94, 100 are converging. In some embodiments, the sidewalls at the indents 94, 100 are not converging while the adjacent forward and rearward portions 90, 92, 96, 98 of the sidewalls are converging.

The front end 82 comprises a front wall 110 and the rear end 84 comprises a back wall 112. In some embodiments, the front wall and back wall converge as they extend from a top 106 of the opening 80 to the bottom 108 of the heel block 14. The front wall 110 and the back 112 wall each comprise an angle that is complementary and configured to mate with the angle of the front wall 72 and back wall 74, respectively, of the key 38 in a dovetail engagement. In some embodiments, the front wall 110 and the back wall 112 are each angled to provide an angle of between 80 degrees and 45 degrees, inclusive, between the respective sidewall and adjacent surface of the bottom 108, but other angles can be used.

Figure 9:
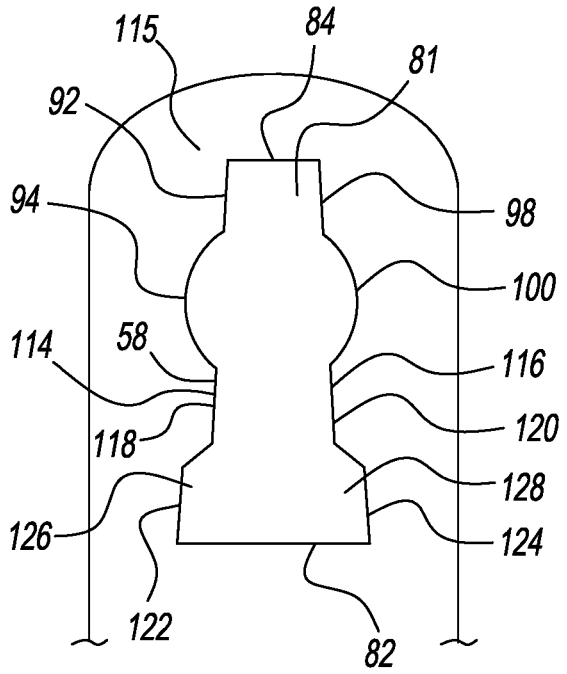
FIG. 9 is a bottom view of a second embodiment top heel block and key opening of the invention.
Figure 10:
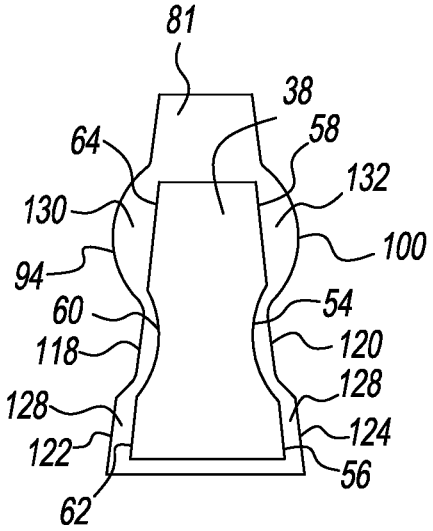
FIG. 10 is a top view of the key of FIG. 8 and the key opening of FIG. 9 with the key shown in a first position.

FIG. 9 shows a second embodiment upper heel block 115, which is the same as heel block 16 except for the shape of the forward portions 118, 120. The sidewalls 114, 116 have forward portions 118, 120 that comprise a forward protrusions 122, 124 creating forward recesses 126, 128. The forward recesses 126, 128 are configured to receive forward portions 52, 62 of the key 38 as shown in FIG. 10. In the embodiment of heel block 16, the forward portions 90, 96 of the heel block 16 are spaced apart sufficiently to allow the forward portions 52, 62 of the key to be received between the forward portions 90, 96.

To engage the key 38 with the upper heel block 14, 115, the key is positioned so that the forward portions 52, 62 are below the forward recesses 126, 128 in the case of heel block 115 or the forward portions 90, 96 in the case of heel block 16. The key is further positioned so that the rearward portions 58, 64 are positioned below the recessed areas 130, 132 formed by the indents 94, 100 of the upper heel block 14, 115. This also causes the portions 118, 120 to be aligned with the spaces allowed by the indents 54, 60 of the key. Then the key is moved upward in the direction A (FIG. 1) so that the key is received in the key opening 80, 81.

Then the key is moved backward in the direction C (FIG. 11) to a locked or engaged position where there is a dove-tail engagement between the sidewall 66 of rearward portion 58 of the key and side wall 102 of the rearward portion 98 of the upper heel block 14, 115, and between the sidewall 68 of the rearward portion 64 of the key and the sidewall 104 of the rearward portion 92 of the upper heel block 14, 115. There will also be a dove-tail engagement between the sidewall 66 of the forward portion 56 of the key and the sidewall 102 of the forward portion 120, 96 of the heel block 115, 16, and between the sidewall 68 of the forward portion 62 of the key and the sidewall 104 of the forward portion 118, 90 of the heel block 115, 16. Further, the indents 54, 60 of the key may be aligned with the respective indents 100, 94 of the heel blocks 115, 16 when in the engaged position as shown in FIG. 11.

FIG. 12 shows a cross-section view of the dovetail engagement between the key 38 and the heel block 115, 14 at portions 56, 62, 118, 120. The engagement at portions 58, 64, 92, 98 is also a dovetail engagement providing a view thereof similar to that of FIG. 12. In some embodiments, at least the portions 65, 62, 68, 64 of the key may be considered a tenon that engage with the sidewall portions 94, 98, 90, 94, 118, 120, which may be considered a mortise.

Figure 11:
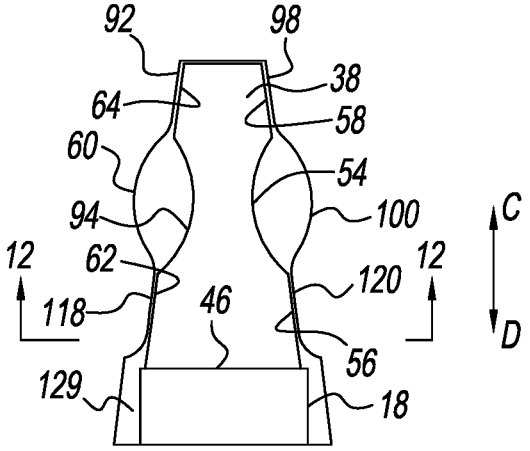
FIG. 11 is a top view of the key of FIG. 8 in the key opening of FIG. 9 with the key shown in a second engaged position.

When the key is in the engaged position shown in FIG. 11, the stop 18 may be inserted into an stop home opening 129 at the front of the key opening 80, 81 and adjacent the front 46 of the key to prevent all or substantial movement of the key in the forward direction D (FIG. 11) and to keep the key securely engaged with the upper heel block 14, 115.

Figure 13:
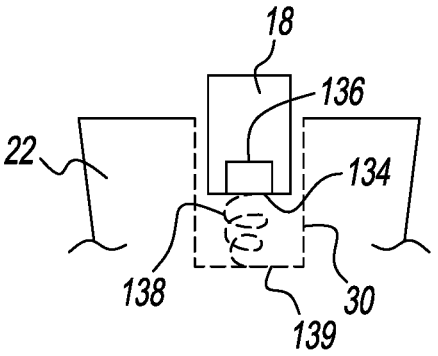
FIG. 13 is a front view of the heel of the shoe of FIG. 1 with a spring recess.

FIG. 13 shows that the stop 18 may be spring biased to the extended/engaged position. A spring 138 may be placed between a bottom 139 of the stop 18 and a bottom 132 of the recess 30 in the heel 22. The spring 138 biases the stop 18 to an engaged position in the stop opening 129 at the front of the key opening 80, 81 and adjacent the front 46 of the key to prevent all or substantial movement of the key in the forward direction D (FIG. 11) and to keep the key securely engaged with the upper heel block 14, 115. The stop 18 may be provided with a handle or protrusion 136 that provides a place for a user to pull the stop down from the engaged position to a disengaged position so that the key 38 can be removed from the heel block 14, 115.

When the stop is withdrawn or removed from the stop opening, the key maybe be moved forward in the direction D until the key is in the position shown in FIG. 10 and then its may be moved downward in the direction B (FIG. 1) to remove the key from the heel block 14, 115 and to remove the heel 22 from the shoe 10.

In some embodiments the key 38 is integrated with the heel 22 and extends from the heel 22 with or without a base 34. In some embodiments, the key opening 80, 81 is formed on the bottom of the sole 26 or upper heel portion 24 with or without a heel block 14, 115.

The key and or the lower heel block 16 can be attached or formed on a variety of heels, such as high heels, low heals, flat heels, no-rise heels, Stellato heels, etc. so that a variety of heels can be interchangeably used with the same shoe.

Figure 14:
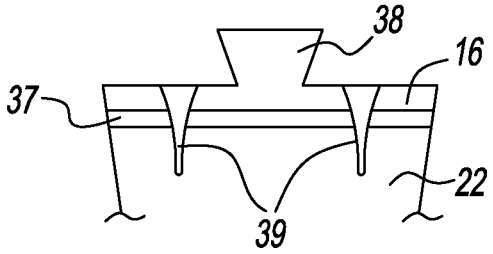
FIG. 14 is a front view of a key and heel used with a shim.

FIG. 14 shows the use of a shim 37 between the lower heel block 16 and the heel 22. In some embodiments multiple shims are used to achieve the desire height. In some embodiments, the shims could be wedges having a taller height at one end of the wedge as compared to another end of the wedge. Wedges or shims could be appropriate where more or less heel height is desired in one shoe for one foot than the other shoe/foot. The wedges or shims could be appropriate to finely adjust the desired heel height in both shoes. The shims and the lower heel block 16 can be joined to the heel 22 with fasteners such as screws 39 or an adhesive or other fastener. The lower heel block can be joined to the shim or wedge and the wedge or shim can be joined to the top of the heel 22. The heel block 14 can be joined to the sole 26 or the heel portion 24 with adhesive or other fastener.

Figure 15:
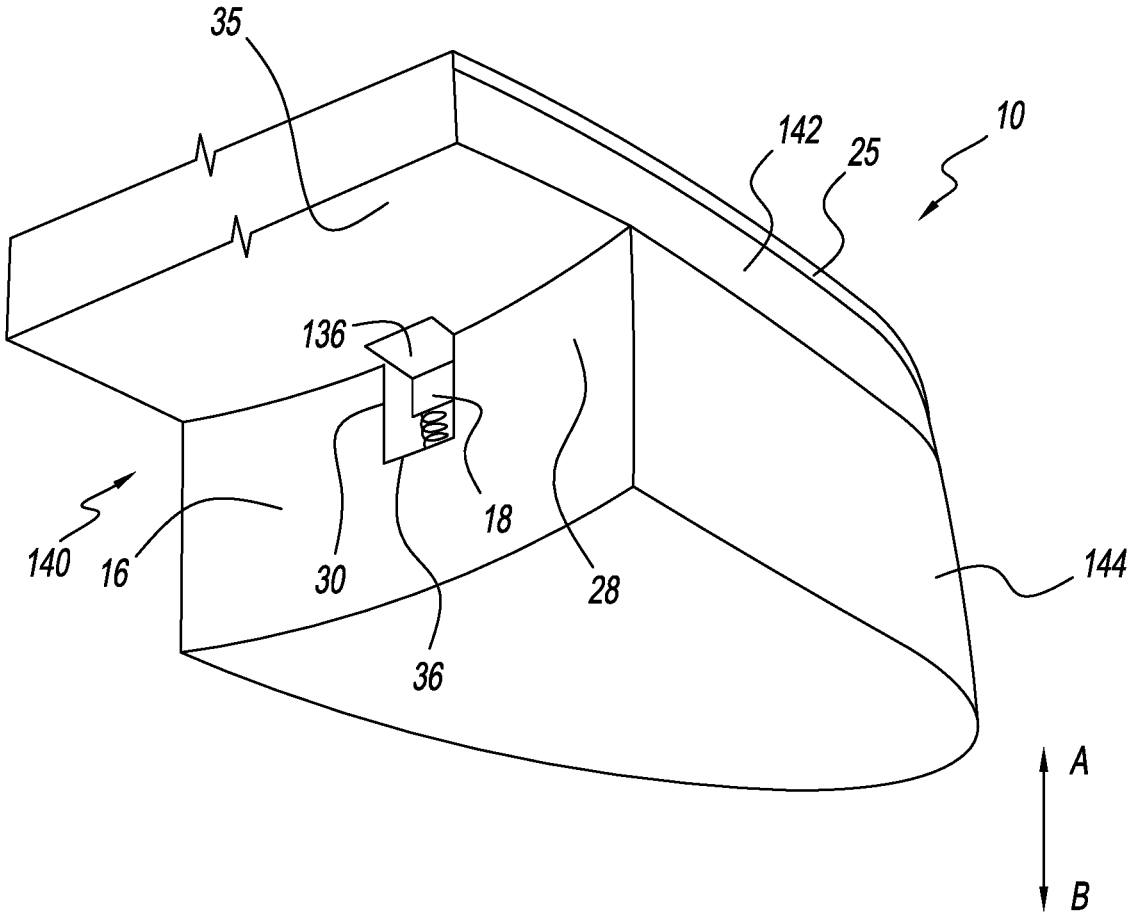
FIG. 15 is a bottom perspective view of a portion of a shoe having a second embodiment interchangeable heel device of the invention.
Figure 16:
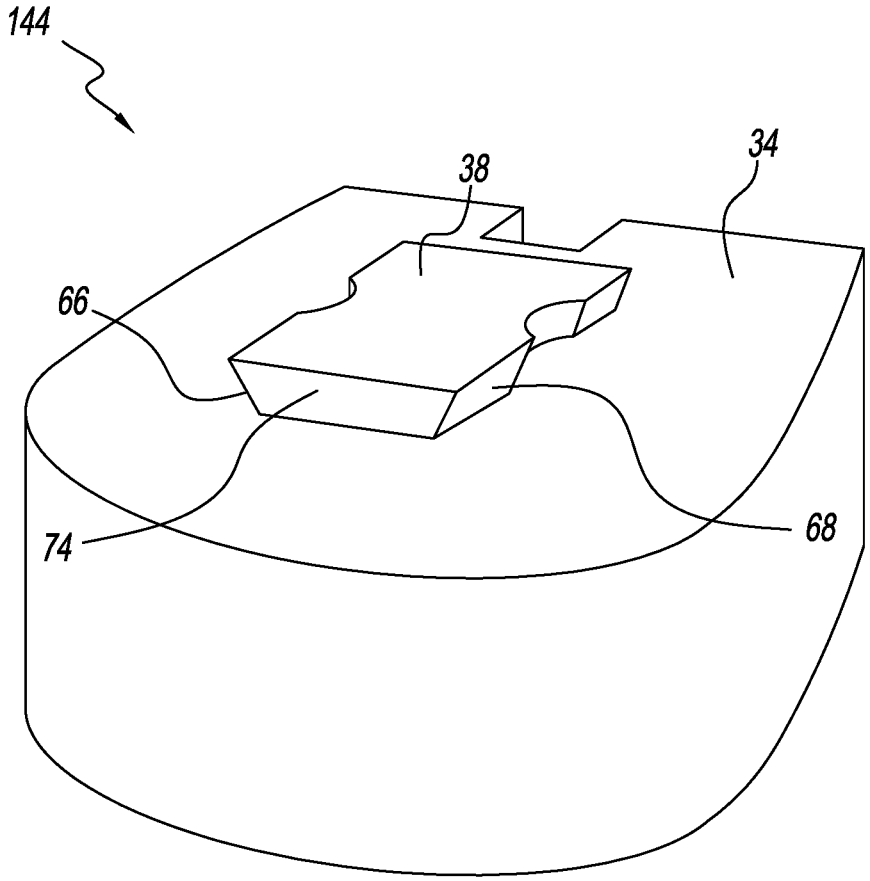
FIG. 16 is a rear perspective view of the heel and key of the interchangeable heel device of FIG. 15.
Figure 17:
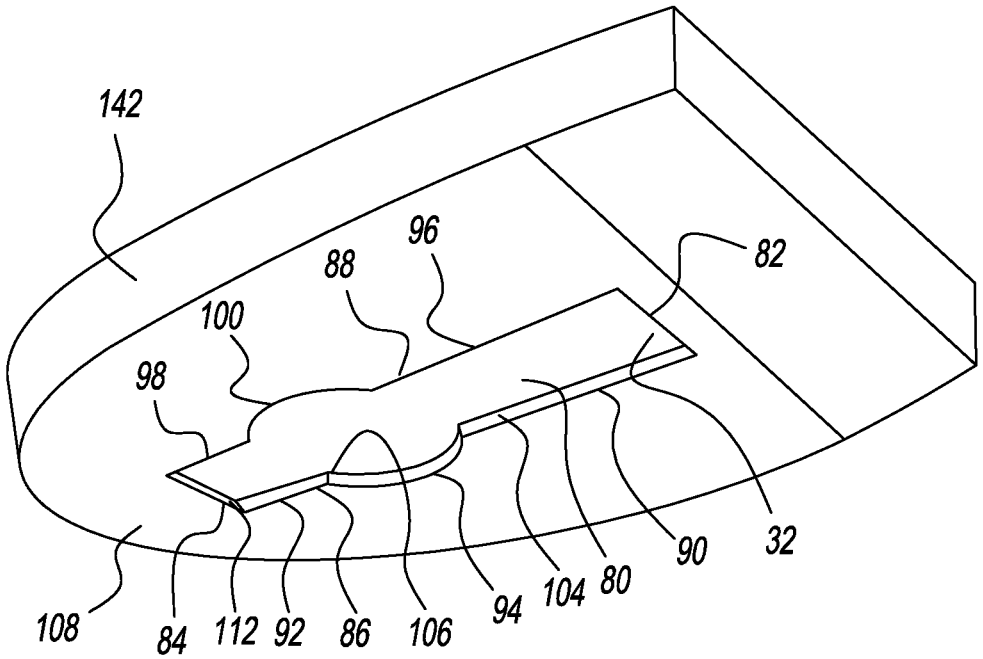
FIG. 17 is a bottom side perspective view of the sole and key opening of the interchangeable heel device of FIG. 15.

FIGS. 15 to 17 shows a shoe 10 with a second embodiment interchangeable heel device 140 comprising heel 144 and the key opening 80 in the sole 142. The sole 142 is the same as sole 26 except that the sole 142 comprises the receiving recess or key opening 80. Therefore, the shoe 10 of FIG. 15 does not have an upper heel block. The heel 144 is the same as lower heel block 16 except that heel 144 is shown having a taller height in the figures. The heel 144 comprises the key 38. The heel 144 is removably connected to the bottom of the sole 142 by engaging the key 38 in the key opening 80, as described above regarding device 12.

In some embodiment, the heel blocks 14, 16, heel 144, the sole about the key opening 80, and key 38 can be made of a dense plastic, rubber, ABS or nylon type material, and/or metal, either cast or machined or combination of techniques. Metal could also be used. In some embodiment, all or a portion of the device 12, 140 and/or the sole 26 of the shoe 10 could be made using 3-D printer technology.

In some embodiments, the device 12, 140 and the shoe 10 does not require the user to remove the shoe from his or her foot in order to detach and change heels, since the stop 18 is located conveniently on an outside surface of the shoe, on the vertical surface of the heel closest to the ball of the foot. The user can will push the stop to the released position toward the bottom of the heel, emptying the area that allows the key to disengage. The user can then bump the heel gently in the forward direction to disengage the key from the key opening and the heel is off. Reversing this procedure will install the desired heel to the shoe.

The device 12, 140 can accomplish the purpose of great reliability and stability connecting the shoe heel to the shoe body, simply and economically. The great ease of engaging and disengaging this device 12, 140 accomplishes the benefits of practicality of comfort, health and fashion versatility within modern lifestyle constraints. The device 12, 140 allow detachable heels that can be interchangeably used with a shoe, such as the shoe 10.

While the shoe 10 of FIG. 10 is shown as an open toes sandal style shoe, but other styles of shoes, including close toed shoes and boots, may comprise the interchangeable heel device 12, 140.

From the foregoing, it will be observed that numerous variations and modifications may be affected without departing from the spirit and scope of the invention. It is to be understood that no limitation with respect to the specific apparatus illustrated herein is intended or should be inferred. For example, one or more component embodiments may be combined, modified, removed, or supplemented to form further embodiments within the scope of the invention. Further, steps could be added or removed from the processes described. Therefore, other embodiments and implementations are within the scope of the invention.

The invention claimed is:

1. A shoe having an interchangeable heel, comprising:

a sole;

a receiving recess in a heel area of the shoe below an insole of the sole;

a heel comprising a key on a top side of the heel configured to engage the receiving recess;

the key comprises a first key side opposite a second key side, the first and second key sides each comprise a key first engagement portion and a key second engagement portion and a key recessed region between the key first engagement portion and the key second engagement portion;

the receiving recess comprises a perimeter, the perimeter comprises a first receiving side opposite a second receiving side, the first and second receiving sides each comprise a receiving first engagement portion and a receiving second engagement portion and a receiving non-engagement recess between the receiving first engagement portion and the receiving second engagement portion; and, the key movable within the receiving recess between a released position and an engaged position, in the engaged position each key first engagement portion is engaged with one of the receiving first engagement portions and each key second engagement portion is engaged with one of the receiving second engagement portion to join the key to the perimeter and the heel to the sole, in the released position each key first engagement portion is aligned with one of the receiving non-engagement recesses and the key is removable from the receiving recess.

2. The shoe of claim 1, the first and second receiving sides each comprise a second receiving recess adjacent the receiving second engagement portion, wherein in the released position each key second engagement portion is aligned with one of the receiving second engagement portions and the key is removable from the receiving recess.

3. The shoe of claim 1, wherein the key first engagement portion of the first key side is converging with the key first engagement portion of the second key side in at least one first direction, wherein the receiving first engagement portion of the first receiving side is converging with the receiving first engagement portion of the second receiving side in at least one second direction.

4. The shoe of claim 1, wherein the key is friction fitted within the receiving recess when in the engaged position.

5. The shoe of claim 1, wherein a least a portion of the key is a tenon and a portion of the perimeter of the receiving recess is a mortise for receiving the tenon when the key is in the engaged position within the receiving recess.

6. The shoe of claim 1, wherein the key engages the receiving recess when in the engaged position for form a dove-tail engagement between the key and at least a portion of the perimeter of the receiving recess.

7. The shoe of claim 1, comprising a stop configured to engage the key and prevent the key from moving to the released position.

8. The shoe of claim 7, comprising a spring to bias the stop to a blocking position preventing the key from moving to the released position.

9. The shoe of claim 1, wherein the heel is selected from the group consisting of a high heel and a low heel.

10. The shoe of claim 1, wherein the first and second key sides are angled and wherein the first and second receiving sides are complementary angled to the angle of the respective first and second key sides.

11. The shoe of claim 1, comprising an upper heel block, the upper heel block comprising the receiving recess, the upper heel block fixed to the shoe below the insole.

12. The shoe of claim 11, comprising a lower heel block, the key extends above a base of the lower heel block, heel comprises the lower heel block.

13. The shoe of claim 1, wherein the key comprises a wedge shape and the receiving recess comprises a wedge shape, wherein the key is friction fitted into the receiving recess when in the engaged position.

* * * * *